US009280955B2

(12) United States Patent
Van Baarsen et al.

(10) Patent No.: US 9,280,955 B2
(45) Date of Patent: Mar. 8, 2016

(54) AUTOMATIC WAVEFORM LINKING IN AN ELECTROPHORETIC DISPLAY CONTROLLER

(75) Inventors: John Peter Van Baarsen, Delta (CA); Yun Shon Low, Vancouver (CA); Eric Jeffrey, Richmond (CA)

(73) Assignee: Seiko Epson Corporation, Tokyo (JP)

( * ) Notice: Subject to any disclaimer, the term of this patent is extended or adjusted under 35 U.S.C. 154(b) by 84 days.

(21) Appl. No.: 13/979,998

(22) PCT Filed: Jan. 25, 2012

(86) PCT No.: PCT/US2012/022564

§ 371 (c)(1),
(2), (4) Date: Jul. 16, 2013

(87) PCT Pub. No.: WO2012/109017

PCT Pub. Date: Aug. 16, 2012

(65) Prior Publication Data

US 2013/0300779 A1 Nov. 14, 2013

Related U.S. Application Data

(60) Provisional application No. 61/440,682, filed on Feb. 8, 2011.

(51) Int. Cl.

| | |
|---|---|
| ***G09G 5/10*** | (2006.01) |
| ***G09G 5/36*** | (2006.01) |
| ***G09G 3/00*** | (2006.01) |
| ***G09G 3/34*** | (2006.01) |

(52) U.S. Cl.

CPC ..... *G09G 5/363* (2013.01); *G09G 3/007* (2013.01); *G09G 3/344* (2013.01); *G09G 2230/00* (2013.01); *G09G 2310/021* (2013.01); *G09G 2310/0202* (2013.10); *G09G 2310/04* (2013.01); *G09G 2310/067* (2013.01); *G09G 2320/041* (2013.01); *G09G 2360/12* (2013.01)

(58) Field of Classification Search

None

See application file for complete search history.

(56) References Cited

U.S. PATENT DOCUMENTS

2008/0291184 A1 * 11/2008 Zhou et al. ..... 345/205

FOREIGN PATENT DOCUMENTS

JP 2008-508548 3/2008

* cited by examiner

*Primary Examiner* — Kenneth B Lee, Jr.

(57) ABSTRACT

In a linked waveform update mode, an impulse-driven, particle-based electrophoretic display may be updated using a first waveform and then automatically up-dated using a second drive scheme when the update using the first waveform finishes. The display may be automatically up-dated using a third drive scheme when the update using the second drive scheme finishes. The automatic updating using a subsequent drive scheme may be interrupted if the desired display states for the region changes after performing the first update. Waveforms may be selected using: (a) the desired display state of a pixel if the desired display state is a valid display state for the specified drive scheme, or (b) a mapped display state of the pixel if the desired display state is an invalid display state for the drive scheme.

13 Claims, 10 Drawing Sheets

AUTOMATIC WAVEFORM LINKING IN AN ELECTROPHORETIC DISPLAY CONTROLLER

CROSS REFERENCE TO RELATED APPLICATIONS

The present application claims the benefit under 35 USC Section 119(e) of U.S. Provisional Patent Application Ser. No. 61/440,682, filed Feb. 8, 2011. The present application is based on and claims priority from the provisional application, the disclosure of which is hereby expressly incorporated herein by reference in its entirety.

FIELD

Disclosed embodiments relate generally to devices and methods for changing the display states of pixels of impulse-driven, particle-based electrophoretic display devices.

BACKGROUND

A material may have two or more display states differing in at least one optical property and for which a first display state may be changed to a second display state by applying an electric field to the material. A material of this type may be referred to herein as an "electro-optic" material. Pixels of a display device may incorporate an electro-optic material, providing a way for making the appearance of the pixels changeable. Although the optical property is typically color perceptible to the human eye, it may be another optical property, such as optical transmission, reflectance, luminescence, or pseudo-color. Pseudo-color refers to the reflectance of electromagnetic wavelengths outside the visible range. Pseudo-color may be used in displays intended for machine reading.

An optical state between two extreme optical states of a pixel may be referred to as a "gray state." In addition, the two extreme optical states themselves may also be referred to as a gray state. The two extreme optical states need not be black and white. For example, the extreme states may be white and dark blue so that an intermediate gray state is a shade of blue. Nonetheless, extreme optical states may be referred to herein for convenience as black and white.

When an electric field of sufficient strength and proper direction is placed across an electro-optic pixel, the display state of the pixel changes. In a display device, the electric field may be created with a pair of electrodes. In particular, each pixel may be placed between a transparent, common electrode on the side of the pixel that is viewed by a user and an addressable electrode on the opposite side of the pixel. In one embodiment, the electric field required to change the state of electro-optic pixels of a display may be provided by an "active matrix" of non-linear elements, such as transistors or diodes. In an active matrix, each pixel is associated with at least one non-linear element. The pixels are arranged in rows and columns and each pixel is addressable according to its row and column position. In an exemplary active matrix display, the image may be updated one row at a time. A first voltage is applied to the common electrode. An activation voltage is applied to activate all of the non-linear elements for a particular row. A second voltage is applied to the column electrodes of desired pixels. The difference between the first and second voltages establishes the electric field that drives the particular pixels in the selected row to their new display states. Generally speaking, the magnitude and direction of the second voltage depends on the desired new display state. After an interval known as the "line address time" the column voltages are removed, the selected row is deselected, and the process may be repeated for the next row. The difference between the first and second voltages may be referred to as an "impulse," as explained below. As further explained below, it is desirable with certain display devices to apply two or more impulses to a pixel when changing a pixel to a new display state.

When a pixel is driven to a new display state, it may maintain the new state after the electric field is removed, i.e., the display state may persist. Persistence refers to how long a pixel maintains a new display state after an electric field (or sequence of fields) is removed. Persistence may be defined with respect to line address time, the time associated with a sequence of electric fields, i.e. multiple line address times, an impulse, a sequence of impulses, a display refresh time, or in another suitable manner. If the display state of an electro-optic pixel persists, the pixel may be referred to herein as "bistable." As one example, an electro-optic pixel for which a new display state persists for at least one order of magnitude longer than a typical liquid crystal display (LCD) pixel after being changed to the new display state may be considered bistable. As another example, an electro-optic pixel for which a new display state persists for at several times longer than a typical liquid crystal display (LCD) pixel after being changed to the new display state may be considered bistable. The term bistable may be used herein, for convenience, to refer to both pixels that have two display states and to pixels that have more than two display states, the later technically being multistable.

The term "impulse" may be used herein to mean the integral of voltage with respect to time. However, some bistable, electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

While the pixels of an impulse-driven electro-optic display may be driven directly from an initial display state to a final display state ("general grayscale image flow"), this technique may result in errors. For example, errors encountered in practice include:

(a) Prior State Dependence. With at least some electro-optic media, the impulse required to switch a pixel to a new display state depends not only on the current and desired display state, but also on the previous display states of the pixel.

(b) Dwell Time Dependence. With at least some electro-optic media, the impulse required to switch a pixel to a new display state depends on the time that the pixel has spent in its various display states. The precise nature of this dependence is not well understood, but in general, more impulse is required the longer the pixel has been in its current display state.

(c) Temperature Dependence. The impulse required to switch a pixel to a new display state depends heavily on temperature.

(d) Humidity Dependence. The impulse required to switch a pixel to a new display state depends, with at least some types of electro-optic media, on the ambient humidity.

(e) Mechanical Uniformity. The impulse required to switch a pixel to a new display state may be affected by mechanical variations in the display, for example variations in the thickness of an electro-optic medium or an associated lamination adhesive. Other types of mechanical non-uniformity may arise from inevitable variations between different manufacturing batches of medium, manufacturing tolerances and materials variations.

(f) Voltage Errors. The actual impulse applied to a pixel will inevitably differ slightly from that theoretically applied because of unavoidable slight errors in the voltages delivered by drivers.

General grayscale image flow also suffers from an "accumulation of errors" phenomenon. For example, assume that temperature dependence results in a 0.2 L* (where L* has the usual CIE definition:

$$L^*=116(R/R0)1/3-16,$$

where R is the reflectance and R0 is a standard reflectance value) error in the positive direction on each transition. After fifty transitions, this error will accumulate to 10 L*. As a second example, assume that the average error on each transition, expressed in terms of the difference between the theoretical and the actual reflectance of the display is ±0.2 L*. After 100 successive transitions, the pixels will display an average deviation from their expected state of 2 L*. Deviations due to an accumulation of errors may be apparent to the observer.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791. Rotating bichromal member type displays use a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field, rotating the bodies to various positions and varying which of the sections of the bodies is seen through a viewing surface. This type of display may be bistable.

Another type of electro-optic display uses an electrochromic medium. For example, a nanochromic film that includes an electrode formed at least in part from a semi-conducting metal oxide and two or more dye molecules capable of reversible color change attached to the electrode. Nanochromic films of this type are described, for example, in U.S. Pat. Nos. 6,301,038; 6,870.657; and 6,950,220. This type of display may be bistable.

Another type of electro-optic display is an electro-wetting display. See for application Ser. No. 10/711,802, filed Oct. 6, 2004 (Publication No. 2005/0151709). This type of display may be bistable.

Another type of electro-optic display is the particle-based electrophoretic display. Electrophoretic displays include two or more charged particles suspended in a fluid that may be made to move through the fluid under the influence of an electric field. The fluid is typically a liquid, but electrophoretic media may be produced using gaseous fluids. This type of display may be bistable. One commercial example is "electronic ink" available from E Ink Corp, Cambridge, Mass., a subsidiary of E Ink Holdings, Inc., Taiwan.

One type of electrophoretic display employs encapsulated electrophoretic media. Encapsulated electrophoretic media includes numerous small capsules. Each capsule includes an internal phase containing electrophoretically-mobile particles suspended in a liquid medium. A capsule wall surrounds the internal phase. Typically, the capsules are themselves held within a polymeric binder to form a coherent layer that may be positioned between two electrodes.

Another type of electro-optic display is the polymer-dispersed electrophoretic display. The polymer-dispersed electrophoretic media may be regarded as sub-species of encapsulated electrophoretic media. In a polymer-dispersed electrophoretic display, a continuous phase of a polymeric material is substituted for the walls surrounding discrete microcapsules of an encapsulated electrophoretic medium. The electrophoretic medium includes two or more discrete droplets of an electrophoretic fluid. The discrete droplets of electrophoretic fluid may be regarded as capsules or microcapsules even though no discrete capsule membrane is associated with each individual droplet. See, for example, U.S. Pat. No. 6,866,760.

A related type of electrophoretic display is a so-called "microcell electrophoretic display." In a microcell electrophoretic display, the charged particles and the suspending fluid are not encapsulated within microcapsules but instead are retained within a plurality of cavities formed within a carrier medium, typically a polymeric film. See, for example, International Application Publication No. WO 02/01281, and published US Application No. 2002/0075556.

Although electrophoretic media are often opaque and operate in a reflective mode, many electrophoretic displays can be made to operate in a so-called "shutter mode" in which one display state is substantially opaque and one is light-transmissive. See, for example, U.S. Pat.s Nos. 6,130,774; 6,172,798; 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346.

The bistable or multi-stable behavior of particle-based electrophoretic displays, and other electro-optic displays displaying similar behavior (such displays may be referred to as "impulse driven displays"), is in marked contrast to that of conventional LCDs. Twisted nematic liquid crystals are not bi- or multi-stable but act as voltage transducers, so that applying a given electric field to a pixel of such a display produces a specific gray level at the pixel, regardless of the gray level previously present at the pixel. Furthermore, LCDs are only driven in one direction (from non-transmissive or "dark" to transmissive or "light"). The reverse transition from a lighter state to a darker one is produced by reducing or eliminating the electric field. Generally, the gray level persists only while the electric field is applied. In addition, the gray level of a pixel of an LCD is not sensitive to the polarity of the electric field, only to its magnitude, and indeed for technical reasons LCDs usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

SUMMARY

When a scrolling operation is performed on an impulse-driven, particle-based electrophoretic display, a region of the display may be updated repeatedly, each display update occurring at short time after the previous update. For this reason, it may be desirable to use a drive scheme that provides rapid updates when performing a scrolling operation. Once the scrolling operation is stopped, paused, or even slowed, the region will have been updated with a drive scheme that provides rapid updates. While drive schemes that provide rapid updates have the advantage of being fast, they may suffer from the disadvantage of producing a less desirable appearance than drive schemes that require long periods to complete a display update. One reason for the appearance being less desirable is that rapid drive schemes may provide fewer gray states than slower drive schemes.

The disadvantage of the less desirable appearance of pixels updated using a drive scheme providing rapid updates may be mitigated through the use of a linked waveform method or a display controller providing a linked waveform update mode. In the linked waveform update mode, the pixels of a region of the display are updated using a first drive scheme. The first drive scheme may provide a rapid update, but this is not critical. When the display update using the first drive scheme finishes, the region of the display is automatically updated using a second drive scheme. The second drive scheme, for example, may be a drive scheme that provides more gray states than the first drive scheme. When the second update finishes, the region is rendered with more detail and definition than was present in the rendered image when the first update finished. The region may be automatically updated a third time with a third drive scheme when the update using the second drive scheme finishes, the third drive scheme providing even more gray states than the second drive scheme.

The linked waveform update method or mode may be initiated with a first display update command. The first display update command specifies desired display states for each of the pixels, and at least first and second drive schemes. In response to the command, pixels are updated using the first drive scheme. It is determined whether the desired display states of the pixels remained static during the update using the first drive scheme. If the desired display states of the pixels remained static during the update using the first drive scheme, the pixels may be updated using the second drive scheme.

The updating of the pixels using the first drive scheme may further include evaluating the desired display state of each of the pixels to determine whether the desired display state is a valid display state for the first drive scheme and selecting waveforms from the first drive scheme. Waveforms are selected for use in updating each of the pixels using the first drive scheme. Each waveform may be selected using: (a) the desired display state of the pixel if the desired display state is a valid display state for the first drive scheme, or (b) a mapped display state of the pixel if the desired display state is an invalid display state for the first drive scheme.

DETAILED DESCRIPTION

As described above, the pixels of a display may be arranged in rows and columns between one or more transparent, common electrodes and addressable electrodes, where each pixel is associated with an addressable electrode. The display state of a pixel of an impulse-driven, particle-based electrophoretic display may be changed by placing an electric field across the pixel, the electric field being created by an impulse. It may be desirable to apply a series of two or more impulses to a pixel of an impulse-driven, particle-based electrophoretic display when changing a pixel to a new display state. The impulses in the series may be a positive, negative, or zero voltage. Each impulse in the series may be of equal duration, although this is not critical. A series of two or more impulses applied to a pixel in consecutive time periods may be referred to as a "waveform."

Figure 1:
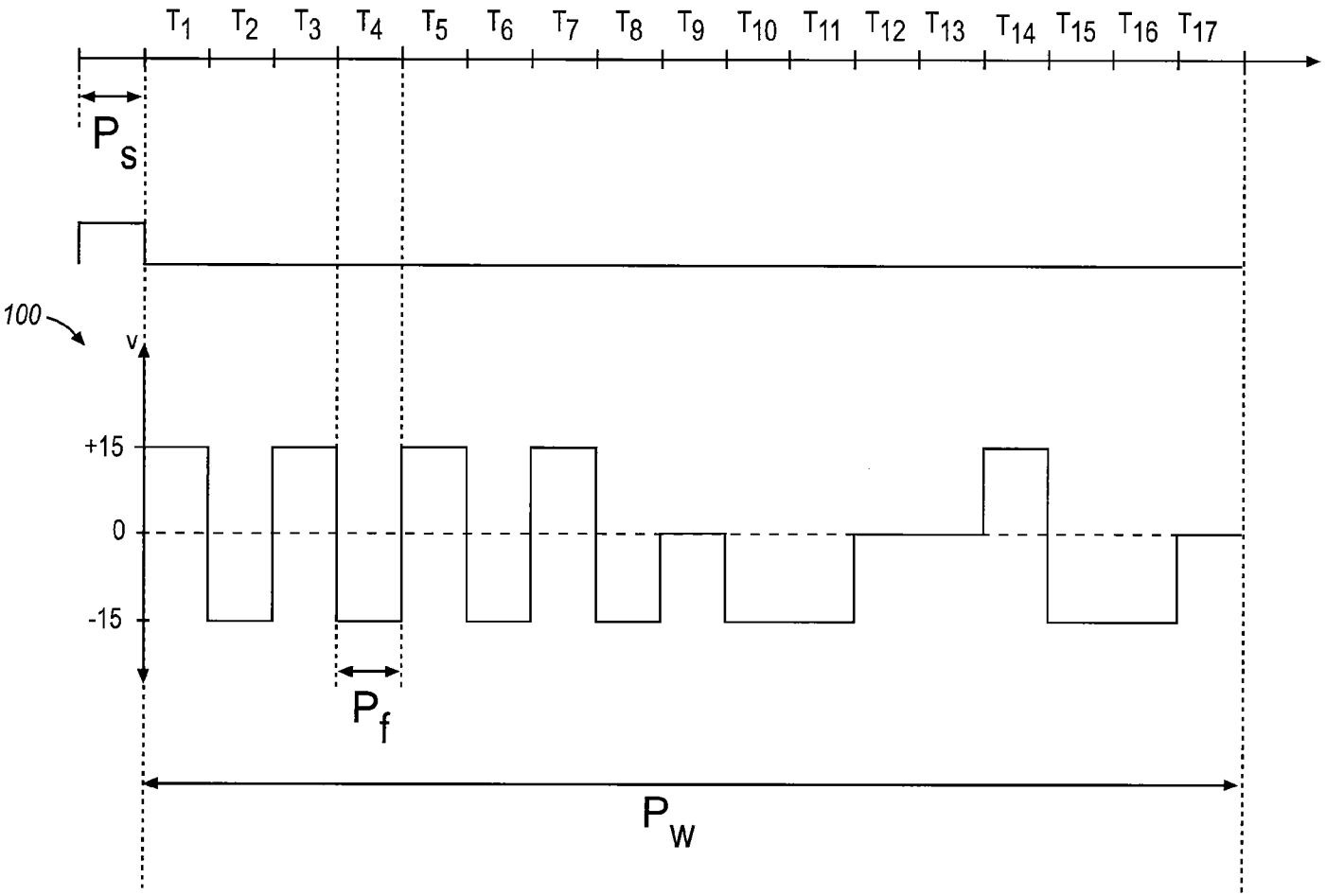
FIG. 1 illustrates the timing of an exemplary waveform and a pixel synthesis operation.

FIG. 1 illustrates an exemplary waveform 100 that may be used to change the display state of a pixel of an impulse-driven, particle-based electrophoretic display employing encapsulated electrophoretic media. The time period in which an impulse may be applied is the frame period $P_f$. An impulse for particular pixel need not be applied for the entire frame period. For example, in frame period T1 an impulse may not be applied to a particular pixel for the entire duration of the period. Rather within the T1 frame period, impulses may be applied to hundreds or thousands of pixels of a display. These impulses are generally not simultaneously applied to all of the pixels in the region of the display being updated. Instead, impulses may be applied simultaneously to pixels of a single row of the display. After applying impulses to one row, impulses may be applied in turn to successive rows during the frame period. The time associated with the entire sequence of frame periods used to change the display state of a pixel is the waveform period P. A period in which no voltage is applied may be referred to as a "resting" period, e.g., frame periods T12 and T13. In addition, as shown in FIG. 1, there may be a time period that precedes the waveform 100 during which a pixel synthesis operation may be performed, designated as period $P_s$.

The length and impulse types of a particular waveform may depend on a number of factors, including but not limited to: the initial display state, the desired new display state, temperature of the pixel, and the characteristics of a particular display. Display state transitions may be defined in terms of the initial and the new or final state. The number of bits used to represent a pixel corresponds with number of possible display state transitions for the particular pixel. A one-bit pixel has just two possible display state transitions, 0 to 1 and 1 to 0, provided that cases where the initial and new display state are the same are ignored, e.g., 0 to 0. A two-bit pixel has 12 possible display state transitions in which the final display state differs from the initial display state.

Generally, other factors being equal, a distinct waveform is required for each display state transition. For instance, for a one-bit pixel, the display state transitions, 0 to 1, and 1 to 0 each require a different waveform. A "drive scheme" describes sets of waveforms that may be used to change the display state of a pixel for all possible transitions from an initial gray level to a final gray level. A drive scheme may include a unique set of waveforms for a number of different temperatures over an operating temperature range. For example, a drive scheme may include ten sets of waveforms, each for use in particular temperature range. The waveform periods for the various waveforms for a particular temperature range may be the same length. A drive scheme may be tailored to provide fast transitions, particular numbers of initial and final gray states, or other factors. A variety of drive schemes may be provided. To further illustrate the drive scheme concept, several exemplary drive schemes are described. It should be appreciated, however, that embodiments implemented in accord with the principles of the invention may be used with any desired waveform or drive scheme, now known or hereafter developed.

A first exemplary drive scheme provides waveforms that may be used to change the display state of a pixel from any initial display state to a new display state of white. The first drive scheme may be referred to as an initialization or "INIT" drive scheme.

A second exemplary drive scheme provides waveforms that may be used to change the display state of a pixel from any initial display state to a new display state of either white or black. The second drive scheme may be referred to as a "DU" drive scheme.

A third exemplary drive scheme provides waveforms that may be used to change the display state of a pixel from any initial display state to a new display state. The initial state may be any four-bit (16 gray states) value. The new display state may be any two-bit (4 gray states) value. The third drive scheme may be referred to as a "GC4" drive scheme.

A fourth exemplary drive scheme provides waveforms that may be used to change the display state of a pixel from any initial display state to a new display state. The initial state may be any four-bit (16 gray states) value. The new display state may be any four-bit (16 gray states) value. The fourth drive scheme may be referred to as a "GC16" drive scheme.

A fifth exemplary drive scheme provides waveforms that may be used to change the display state of a pixel from an initial display state to a new display state. The initial state must be white or black. The new display state may be black or white. The fifth drive scheme may be referred to as an "A2" drive scheme. An advantage of A2 waveforms is that they have generally short waveform periods, providing rapid display updates. A disadvantage of A2 waveforms is that there use may result in ghosting artifacts.

The exemplary drive schemes along with exemplary, estimated waveform periods are summarized in Table 1;

TABLE 1

| Type | Initial State | Final State | Waveform Period |
|---|---|---|---|
| INIT | 0-F | F | ~4000 ms |
| DU | 0-F | 0 or F | ~260 ms |
| GC4 | 0-F | 0, 5, A, or F | ~500 ms |
| GC16 | 0-F | 0-F | ~760 ms |
| A2 | 0 or F | 0 or F | ~120 ms |

Figure 2:
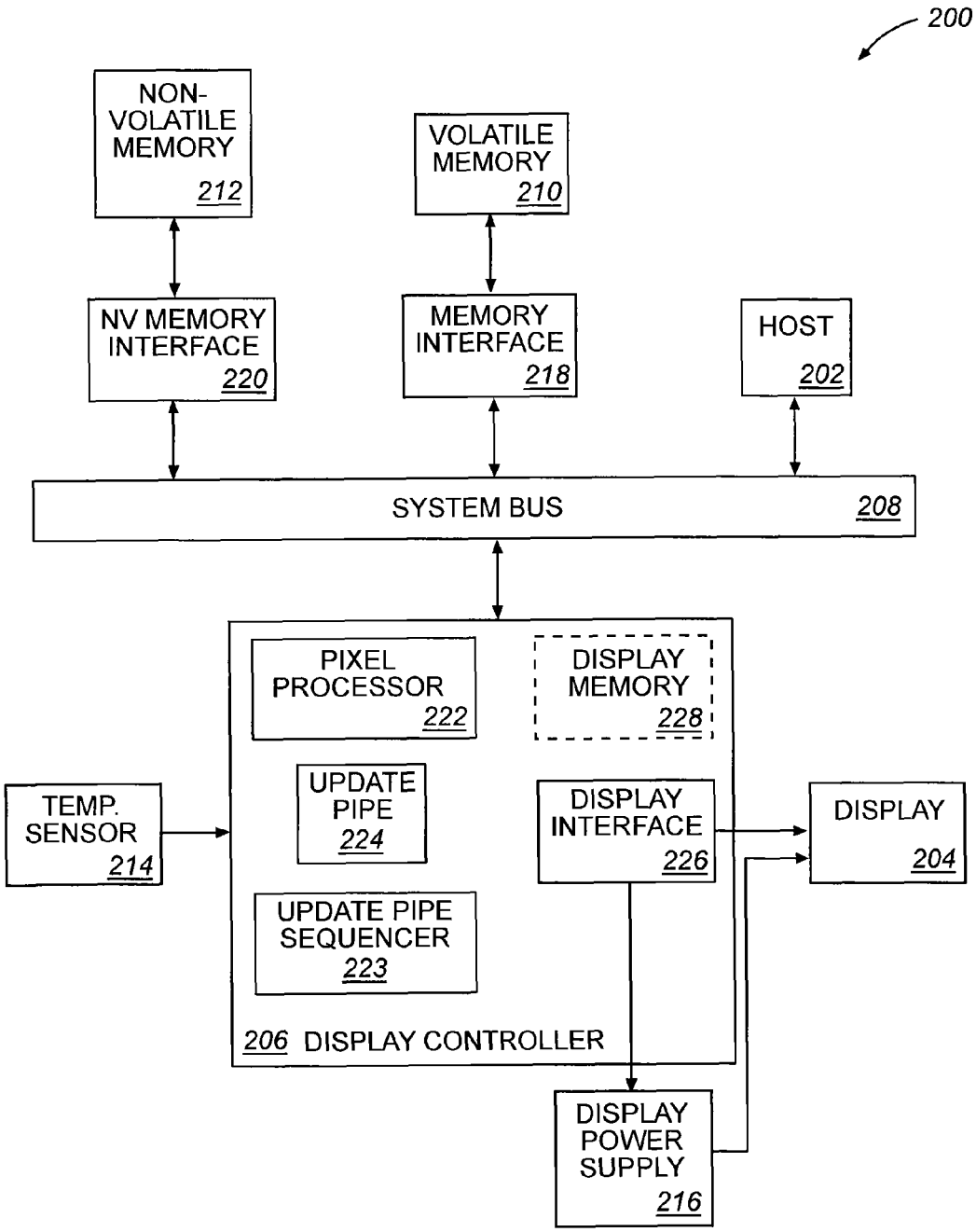
FIG. 2 shows an exemplary display system according to one embodiment.

FIG. 2 shows an exemplary display system 200 according to one embodiment. The system 200 may include a host 202, a bistable, display device 204, a display controller 206, a system bus 208, and a volatile memory 210. The system 200 may also include a non-volatile memory 212, a temperature sensor 214, and a display power supply 216. The system 200 may include memory interfaces 218, 220 for the volatile and non-volatile memories 210, 212, respectively. The host 202 may be a CPU, DSP, or other device for interfacing with the display controller 206. The display device 204 may be an impulse-driven, electro-optic display. The display device 204 may be a bi-stable display. The display device 204 may be an impulse-driven, electro-optic, particle-based display device incorporating encapsulated electrophoretic media, polymer-dispersed electrophoretic media, or microcell electrophoretic media. The system bus 208 may be either a serial or parallel bus. In one embodiment, the system bus 208 is an $I^2C$ serial bus. The temperature sensor 214 may include an integrated bus interface (or a separate bus interface may be provided). The display controller 206 may include a pixel processor 222, an update pipe sequencer 223, one or more update pipes 224, a display interface 226, and, optionally, a display memory 228. The display controller 206 may be distinct integrated circuit ("IC") or it may be included with one or more other components on a System-On-A-Chip ("SOC") IC. The system 200 is but one environment in which embodiments may be implemented. It should be understood that the system 200 is shown with components that may be pertinent the exemplary environment. For purposes of clarity, other components have been omitted. It should be appreciated that embodiments and implementations according to the principles of the invention may include additional components or different components from those shown in the figures. In some embodiments, the shown system 200 may be included in an electronic device such as a general purpose computing device, an electronic reader, a tablet computing device, a cellular telephone, or an "intelligent" consumer appliance.

Figure 3:
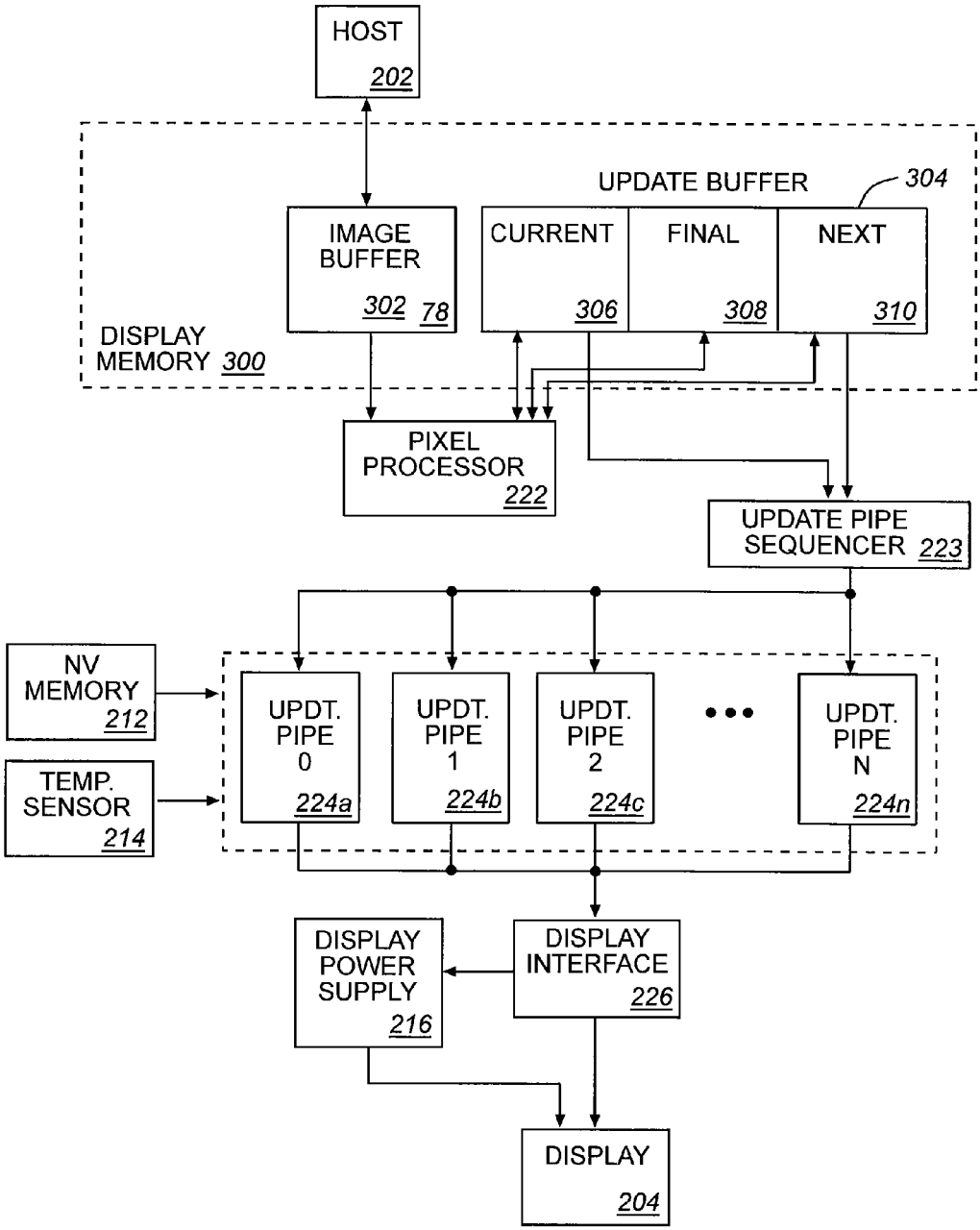
FIG. 3 illustrates exemplary data paths in the system of FIG. 2 according to one embodiment.

FIG. 3 illustrates exemplary data paths in the system 200 according to one embodiment. A display memory 300 is shown in FIG. 3. The display memory 300 may be a dedicated region of the volatile memory 210. Alternatively, the display memory 300 may be integral with the display controller 206, e.g. display memory 228. The display memory 300 may include an image buffer 302 and an update buffer 304. The update buffer 304 may include a current state buffer 306, a final state buffer 308, and a next state buffer 310. The host 202 or other image data source, such as a camera or a DMA unit, may store desired new display states for pixels of an image or a portion of an image in the image buffer 302. Each of the buffers 302, 306, 308, and 310 may include a memory location for each pixel location of a display device.

When the display 204 is updated or refreshed, it is updated with desired new display states stored in the image buffer 302. Accordingly, when one wants to update the image on the display 204, the desired new display states are generally first stored in the image buffer 302. The storing of image data in the image buffer 302 alone, however, does not trigger a display update. The host 202 or other image data source must additionally issue a display update command. The display update command may specify the entire display, or one or more regions of the display to be updated. The display update command may also specify a drive scheme to be used for the update. According to one embodiment, the display update command may specify two or more drive schemes and the order in which the drive schemes are to be used, as further explained below. Generally, two operations are performed in response to a display update command. The first is a pixel synthesis operation. The second is a display output operation. The display output operation uses the results of the pixel synthesis operation to identify specific waveforms of a drive scheme. Impulses of identified waveforms are provided to the display 204 during each frame period of the waveform period, thereby changing the display states of the pixels in the specified region.

According to the principles of the invention, two modes may be provided for updating the image rendered on the display device 204: (a) single waveform update mode; and (b) linked waveforms update mode. Either mode may be used to update the entire display or one or more regions of the display. Either mode may be invoked with a display update command.

Referring to FIG. 3, the single waveform update mode is first described. The first operation in a single waveform update is a pixel synthesis operation. A first step in a pixel synthesis operation may be to copy the display state values stored in the next state buffer 310 to the current state buffer 306, overwriting the previously stored values. The reason for this step is as follows. At the time that the display update command issues, the current and next state buffers 306, 310 generally hold historical values for the region of interest. The current and next state values were used in a previous update. Because the drive scheme for the previous update has finished, the next state buffer 310 holds the actual display state of the pixel at the start of a pixel synthesis operation. Because the value in the current state buffer 306 is no longer of interest, it may be overwritten.

In the single waveform update mode, a second step in the pixel synthesis operation is to copy the desired new display states of pixels from the image buffer 302 into the next state buffer 310. When this is done each pair of display states stored in the current state buffer 306 and the next state buffer 310 represent what may be referred to herein as a "synthesized pixel." The drive scheme specified in the display update command may be associated with each synthesized pixel. Alternatively, the specified drive scheme may be associated with a region of the display to be updated.

The second operation in the single waveform update is a display output operation. The display output operation may include a fetching operation. In the fetching operation, the update pipe sequencer 223 may fetch synthesized pixels from the update buffer 304 and provide the fetched, synthesized pixel to an update pipe 224. In one embodiment, the update pipe sequencer 223 may initiate the fetching operation after the pixel synthesis operation is complete. It is not critical, however, that the pixel synthesis operation be fully complete before the update pipe sequencer 223 begins fetching synthesized pixels from the update buffer 304.

When the update pipe 224 receives a synthesized pixel from the update pipe sequencer 223, it identifies the impulse to be applied to the corresponding pixel in the display 204 for the current frame period. In order to identify the impulse, the update pipe 224 must first identify the specific waveform of the specified drive scheme. All possible drive schemes for a display 204 may be stored in a memory, such as the non-volatile memory 212. While the display update command may specify a drive scheme, the particular set of waveforms to use may depend on temperature. The update pipe 224 may select a set of waveforms based on a temperature signal provided by temperature sensor 214. Once the set has been selected, all or part of the set of waveforms may be copied from the non-volatile memory 212 and stored into a look-up table ("LUT") memory associated with the update pipe 224. When the update pipe 224 receives a synthesized pixel, the synthesized pixel may be used to select the appropriate waveform from the set of waveforms stored in the LUT. In addition, the impulse data for the current frame period may be selected. The selected impulse data may be stored in a first-in-first-out memory ("FIFO") memory associated with the update pipe 224. The FIFO memory (not shown) may be provided so that impulse data may be selected and buffered ahead of when it will be needed by the display interface 226.

The display interface 226 may fetch impulse data from the one or more update pipes 224. The display interface 226 provides impulse data to the display power supply 216, which in turn provides actual impulses to the display device 204. The display interface 226 may provide control signals directly to the display device 204. Actual impulses and control signals are provided according to the timing requirements of the display device 204.

For each frame period in a waveform, the update pipe sequencer 223 may fetch the same synthesized pixels from the update buffer 304, providing the synthesized pixels to the update pipe 224. In each frame period, the update pipe 224 identifies impulses to be applied to the corresponding pixels for the current period. The display interface 226 fetches impulse data from the update pipe 224 for each frame period in a waveform. After impulse data for the final frame period in the waveform has been fetched and impulses furnished to the display power supply 216 and the display 204, the display output operation (and the single waveform single waveform update mode update process) is complete.

Before describing the linked waveforms update mode, a scroll down operation is first described. Because it may be beneficial to use two or more drive schemes in the course of a scroll operation, the linked waveforms update mode may be beneficial when a user scrolls a displayed image.

Figure 4:
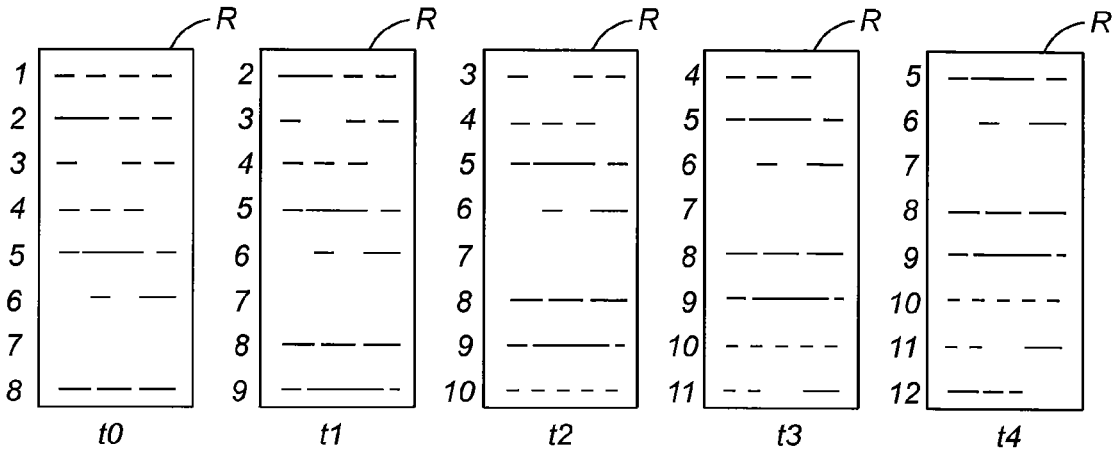
FIG. 4 illustrates an example of a scroll down operation.

FIG. 4 illustrates an example of a scroll down operation. Multiple instances of a region R of a display screen at sequential times during a scroll down operation are shown. Initially, lines 1-8 are rendered at time t0. FIG. 4 shows that a scrolling operation may update a region of the display multiple times. In response to a first scroll command, lines 2-9 are rendered in region R at time t1. Similarly, in response to second, third, and fourth sequential scroll commands, lines 3-10, 4-11, and 5-12 are respectively rendered in region R at times t2, t3, and t4. Because the four scroll commands are often made close together in time, it can be desirable to use a drive scheme that provides rapid updates.

A drive scheme that provides rapid updates, however, may produce images with fewer gray levels than drive schemes providing slow updates. For example, a fast drive scheme may drive pixels to one of only two display states, e.g., A2, which drives pixels to final states of black and white. While the images produced by the faster drive schemes may lack detail and image definition, the lack of gray scale depth in images produced by fast drive schemes may be acceptable provided the image is only briefly displayed, which may be the case in a scroll operation. When a user scrolls a displayed image, an image may be replaced in quick succession with a series of new images. In the example shown in FIG. 4, lines 1-8 in region R may be quickly replaced with lines 2-9, lines 2-9 may be quickly replaced with lines 3-10, lines 3-10 may be quickly replaced with lines 4-11, and so on. The use of faster drive schemes permits scrolling operations to be performed in a way that any user perception of sluggish scrolling is minimized.

Once the scrolling operation is stopped, paused, or even slowed, however, the lack of gray scale depth in the image produced by fast drive scheme can be unacceptable or less than desirable. To overcome the less desirable appearance when scrolling slows or stops, the region last updated with a fast drive scheme during a scroll operation, may be updated a second time with a drive scheme providing greater gray scale depth. For example, assume that lines 4-11 in region R were updated with lines 5-12 in response to a fourth scroll command. In response to the fourth scroll command, region R was updated with lines 5-12 using a fast drive scheme providing only two gray states. After the fourth scroll command, a fifth scroll command is not, at least immediately, issued. If it is determined when the display update using the fast drive scheme finishes that a fifth scroll command has not been issued, then region R may be updated with image data for lines 5-12 a second time. This second update may use a drive scheme providing more than two gray states. When the second update finishes, the region R will be rendered with more detail and definition than was present in the rendered image when the first update finished. Moreover, the region last updated with a fast drive scheme during a scroll operation may be updated a third time with a drive scheme providing even greater gray scale depth than the second drive scheme if the fifth scroll command has not been issued. In fact, the region last updated may be updated as many additional times as desired so long as the fifth scroll command has not been issued.

In order to implement the above-described method of first updating a region with a fast drive scheme and then updating the same region using a drive scheme providing more gray states than were available in the fast drive scheme, provided the user has not issued an additional scroll command during the first update, the host 202 would need to perform a number of operations. First, the host 202 would need to determine when an update using a particular drive scheme is complete. Two, three, or more drive schemes may be used in a sequence of updates, each having different waveform periods. The host 202 might need to keep track of the various waveform periods or continually poll the display controller to learn when a particular drive scheme is complete. In addition, the host 202 would need to determine whether the user had requested an additional scroll operation and, if not, which drive scheme should be used in a next update. Further, the host 202 would need to issue a new display update command each time the same region is to be updated with a drive scheme providing more gray states than were available in the previous drive scheme. Thus, in order to implement the above-described method, a significant number of time-critical tasks would need to be imposed on the host 202. Where the host 202 is fully loaded with other tasks, as is often the case, the operations required to implement the method become a significant disadvantage. This disadvantage may be overcome, however, through the use of a display controller providing a linked waveforms update mode.

The linked waveforms update mode is next described with reference to FIGS. 3 and 5. Like the single waveform update mode, the desired new display states of pixels are generally first stored in the image buffer 302 by the host 202 or other image data source. In addition, like the single waveform update mode, the linked waveform update mode includes a pixel synthesis operation and a display output operation. While the display output operations in both modes are essentially the same, the pixel synthesis operation of the linked waveform update mode is different from the pixel synthesis operation of the single waveform update mode.

Figure 5:
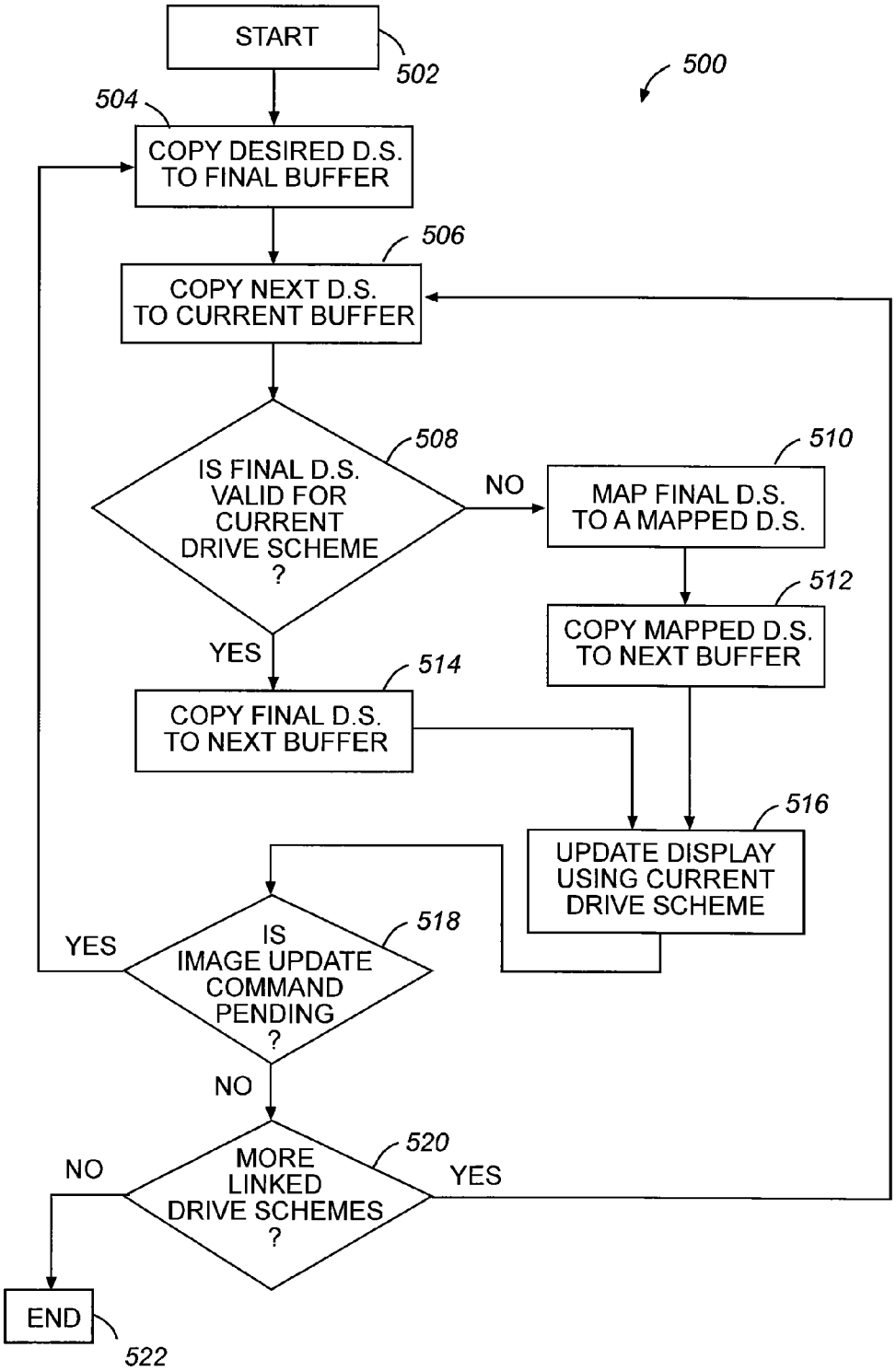
FIG. 5 illustrates a method for performing a linked waveform update mode according to one embodiment

FIG. 5 illustrates a method 500 for performing a linked waveforms update mode according to one embodiment. The linked waveforms display update command will specify two or more drive schemes and an order for using the drive schemes. In operation 504, the desired new display states ("D.S.") may be copied from the image buffer 302 and stored in the final state buffer 308. In operation 506, the next display state values may be copied from next state buffer 310 and stored in the current state buffer 306, overwriting the values previously stored in buffer 306.

In operation 508, the final state for each pixel may be read from the final state buffer 308 and evaluated to determine whether the final state is a valid display state for the current drive scheme. Initially, the current drive scheme is the first drive scheme specified in the linked waveforms display update command. Later, if certain conditions are met, the current drive scheme is set to a next sequential drive scheme, e.g., second, third, etc drive scheme. As an example of determining whether the final state is a valid display state for the current drive scheme, assume the final display state value is 4 and the current drive scheme is GC4. In this example, the final state is invalid. The final state is invalid because the only valid next display states for GC4 are 0, 5, A, and F. If the final state is invalid, the final display state is mapped into a valid display state value (operation 510), e.g., the desired value of 4 may be mapped into the GC4 valid value of 5. The mapped value is then stored in the next state buffer 210 (operation 512). If, on the other hand, the final display state is valid, e.g., 5, the final display state is stored in the next state buffer 210 (operation 514). In one embodiment, a final display state that is invalid may be mapped into a valid display state using a lookup table of predetermined values. A final display state that is invalid may be mapped to a nearest valid value, according to one embodiment.

The operations 504 to 514 describe a pixel synthesis operation for a first drive scheme specified in a linked waveforms display update command. The operations 506 to 514 describe a pixel synthesis operation for second and subsequent drive schemes specified in a linked waveforms display update command.

In operation 516, a display output operation may be performed using the current drive scheme. As described above, a display output operation may include fetching synthesized pixels from the update buffer 304 by an update pipe sequencer 223 and providing the fetched, synthesized pixels to an update pipe 224. The display output operation may also include identifying impulses to be applied to pixels in the display 204 for each frame period. As explained above, an update pipe 224 may identify the specific waveform of the specified drive scheme in order to identify the appropriate impulses. The update pipe 224 may also select a particular set of waveforms from the drive scheme based on a temperature signal provided by temperature sensor 214. In addition, the display output operation may include fetching impulse data from the update pipe 224 and providing the fetched impulse data to the display power supply 216 in each frame period. The impulse data may be fetched by the display interface 226. The display interface 226 may also provide control signals directly to the display device 204 as described above. Further, the display power supply 216 may provide actual impulses to the display device 204. These operations are performed for each frame period in a waveform. After impulse data for the final frame period in the waveform has been fetched and impulses furnished to the display 204, the display output operation using the current drive scheme is complete and the pixels of the display 204 in the region of interest are updated.

When the display output operation 516 is complete, it may be determined in operation 518 whether the desired new display states for the pixels of the updated region have remained static since the last image synthesis operation. Image data will not have remained static if the host 202 or other image data source stored data in the image buffer 302 and issued an image update command after the display output operation 516 started. For example, the host 202 may store new display states for the region of interest in the image buffer 302 during a display output operation in response to a scroll request received from a user. If the new display states for the region have not remained static, the linked waveforms update method 500 is interrupted and cancelled at the end of the display output in operation 516, and the method returns to operation 504 where a new display update is begun. On the other hand, if the new display states for the region have remained static since the last image synthesis operation or image update operation, the operation 520 may be performed.

One way to determine whether or not the new display states for the region have remained static since the last image synthesis operation is to determine whether an image update command was issued either during a pixel synthesis operation or during an image update operation 516. In some embodiments, if an image update command is pending when either a pixel synthesis operation or an image update operation 516 finishes, it may be assumed that the linked waveforms update method 500 should be interrupted and cancelled.

The operation 520 may be performed if the new display states for the updated region have remained static. As mentioned, two or more drive schemes and an order for using the drive schemes may be specified in a linked waveforms display update command. Operation 520 determines whether there are additional specified drive schemes following the display output operation 516 just completed using the current drive scheme. If there are additional drive schemes, operation 520 sets the current drive scheme to a next drive scheme in the sequence of drive schemes. Operation 520 then initiates a next display update using the new current drive scheme, i.e., the method 500 repeats beginning with operation 506. The repeated operations use the desired new display states previously copied into the final state buffer 308 (operation 504 may be omitted). If there are no additional drive schemes to be used following the just-completed display output operation, the method 500 ends (Operation 522).

Figure 6A:
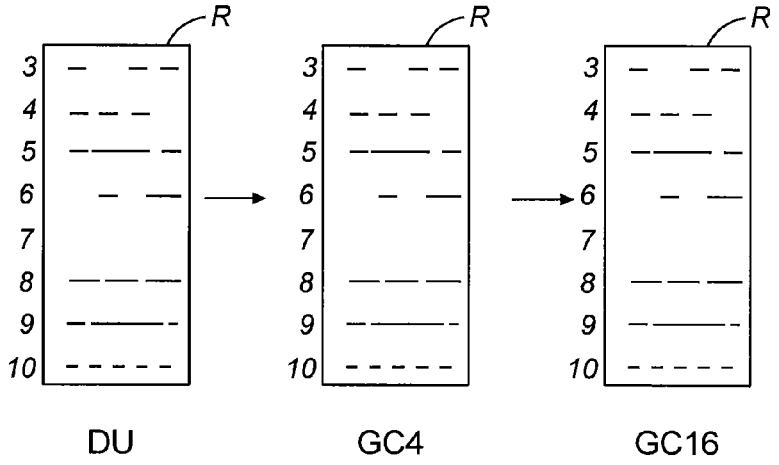
FIG. 6 illustrates two exemplary drive scheme groupings.
Figure 6B:
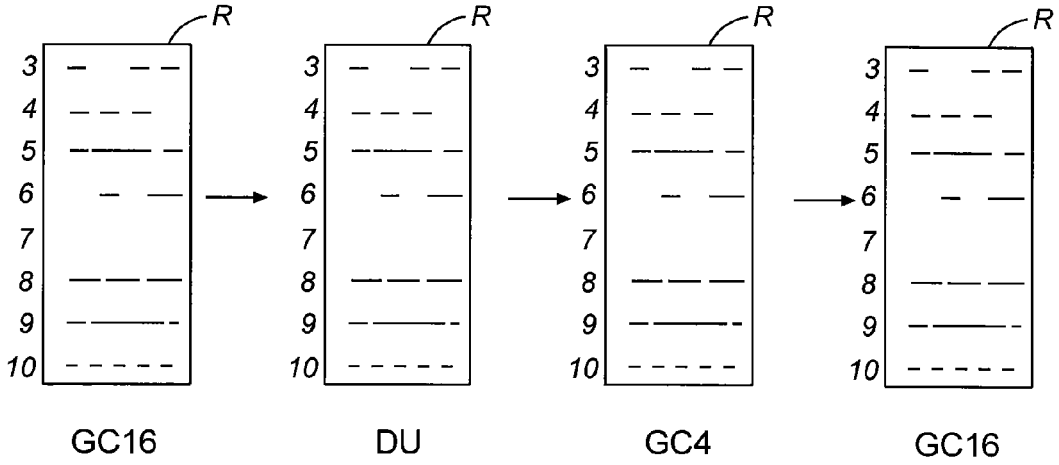

FIG. 6 illustrates two exemplary drive scheme groupings. Group 0 specifies three drive schemes in the order: (1) DU; (2) GC4; and (3) GC16. Group 1 specifies four drive schemes in the order: (1) GC16; (2) DU; (3) GC4; and (4) GC16. FIG. 6A illustrates the region R of display 204 being updated, without interruption, in linked waveforms update mode using group 0. FIG. 6B illustrates the region R of display 204 being updated, without interruption, in linked waveforms update mode using group 1. While the linked waveforms update mode has been explained in a context in which each successive drive scheme includes more gray levels than the preceding drive scheme, the number of gray levels in successive drive scheme is not critical. As shown, in FIG. 6B, a successive drive scheme may include fewer gray levels than a preceding drive scheme. Moreover, while the linked waveforms update mode has been explained in a context of a scroll operation, it is not critical that the linked waveforms update mode be used only with a scroll operation. The linked waveforms update mode may be used whenever it is desirable to update an image two or more times in succession using the same synthesized pixels.

As described above, two operations are generally required to update the display 204: (a) pixel synthesis; and (b) display output. The two operations are required for both the single waveform and linked waveforms mode, although the pixel synthesis operations in the two modes are not identical. Referring again to the exemplary waveform 100 shown in FIG. 1, it can be seen that there is a time period $P_s$ before the waveform 100 begins. This time period $P_s$ represents the time necessary to perform a pixel synthesis operation. The waveform period $P_w$ is the time necessary to perform the display output operation. Depending on the type of drive scheme and other factors, an exemplary display output operation may take 760 ms. An exemplary pixel synthesis operation, in comparison, may require 5 ms to 40 ms to complete, depending on available processing power and available memory bandwidth. The time required to update the display 204 is the sum of the two times, e.g., an exemplary display update may take 765-800 ms.

As described above, the display output operation includes a fetching operation in each frame period. For the waveform illustrated in FIG. 1 the fetching operation for the first frame begins after the pixel synthesis operation is complete. As mentioned, it is not critical that the pixel synthesis operation be fully complete before the update pipe sequencer 223 begins fetching synthesized pixels from the update buffer 304.

Figure 7:
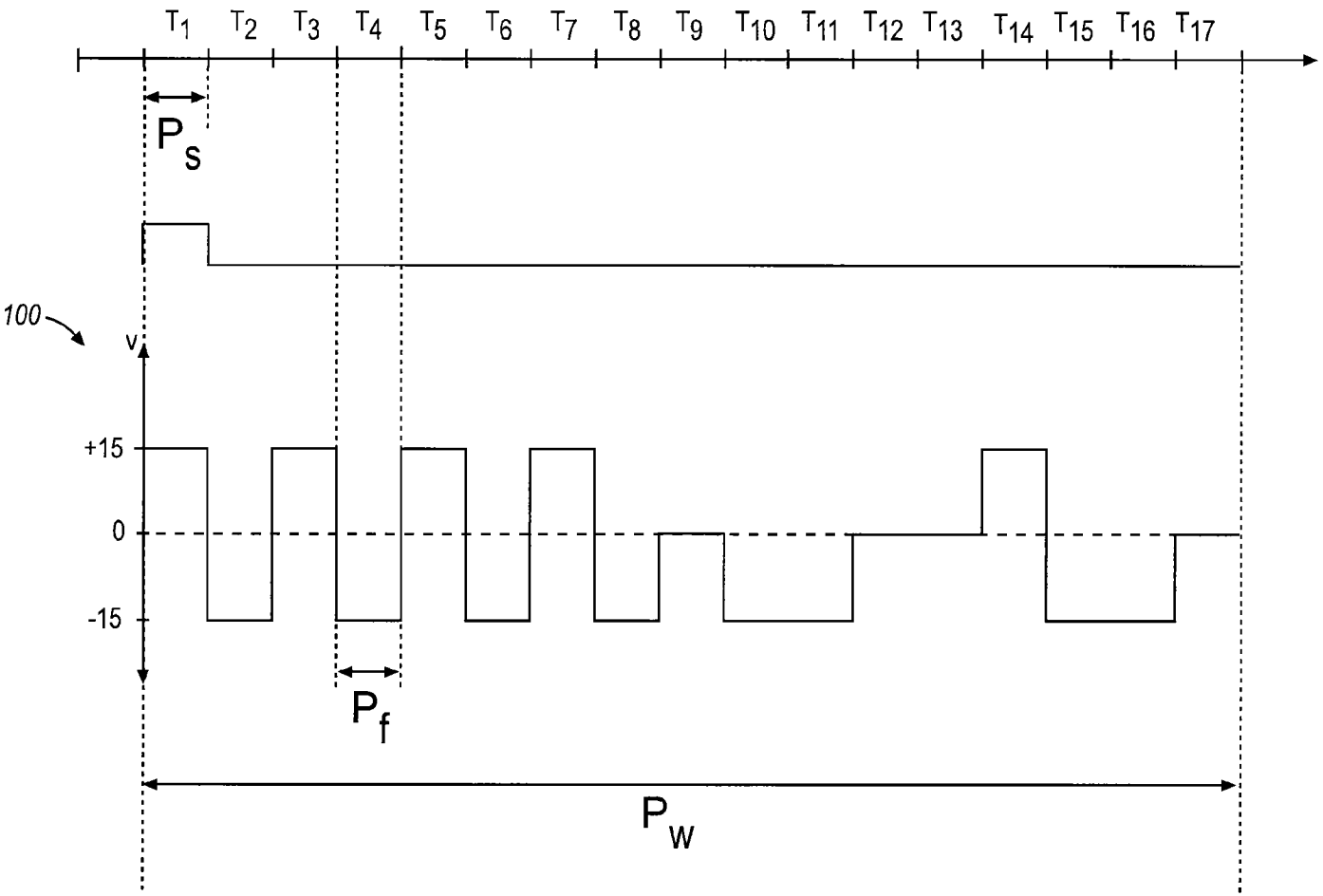
FIG. 7 illustrates the timing of an exemplary waveform and a pixel synthesis operation according to one embodiment.

FIG. 7 illustrates a fetching operation that begins before the pixel synthesis operation is complete according to one embodiment. In a single waveform update, when a display update command is received, a pixel synthesis operation is performed. Pixel synthesis includes copying the next display state value from the next state buffer 310 into the current state buffer 306, and copying the desired new display state from the image buffer 302 into the next state buffer 310. These copying operations are performed for each pixel in the region to be updated. In one embodiment, once these copying operations have been performed for a "first quantity" of pixel locations in the display 204, the display output operation may begin. For example, once next and desired display state values have been copied into the current state buffer 306 and next state buffer 310, respectively, the fetching of synthesized pixels by the update pipe sequencer may begin.

In linked waveforms update mode, when a display update command is received, the next display state value is copied from the next state buffer 310 into the current state buffer 306 and the desired new display state is copied into the final state buffer 308. In addition, either a mapped display state or desired display state is copied into the next state buffer 310. These copying operations are performed for each pixel in the region to be updated. In one embodiment, once these copying operations have been performed for the first quantity of pixel locations in the display 204, the display output operation may begin.

In one embodiment, the first quantity is one or more pixel locations of the display 204. In an alternative embodiment, the first quantity is one line of pixel locations in the region of the display 204 to be updated. The first quantity provides the pixel synthesis operation with a head start over the display output operation. The length of the head start is not critical because the pixel synthesis operation processes individual pixels at least as fast, if not faster than, the display output operation. As can be seen from FIG. 7, the first frame of the display output operation is performed at substantially the same time as the pixel synthesis operation.

Figure 8:
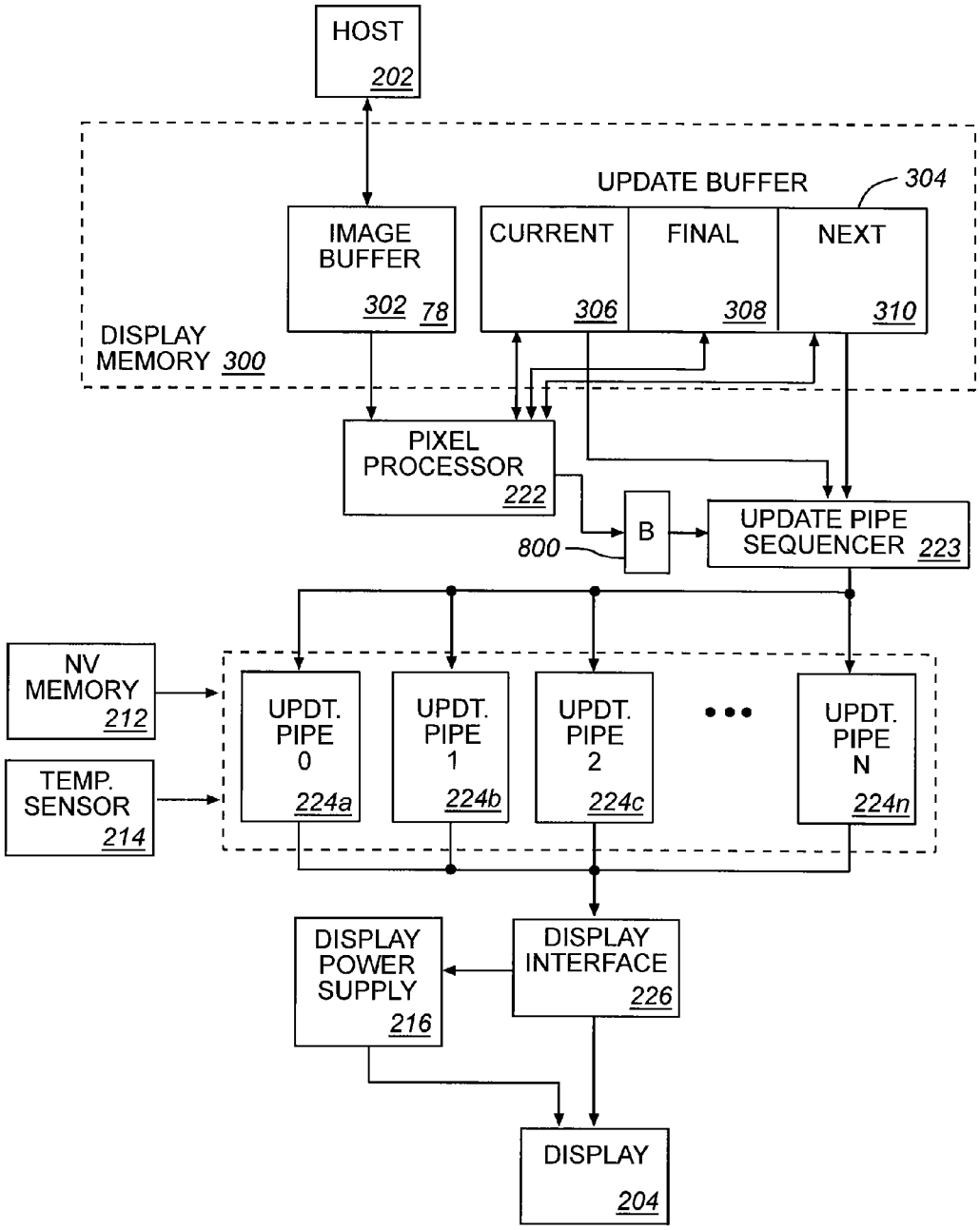
FIG. 8 illustrates exemplary data paths in the system of FIG. 2 according to one embodiment.

FIG. 8 illustrates exemplary data paths in the system 200 according to an alternative embodiment. The system 200 may include a buffer "B," 800. The buffer 800 may be a set of registers in the display contoller 206. In one variation, the buffer 800 may a dedicated memory in the display contoller 206, e.g. part of the display memory 228. Alternatively, the buffer 800 may be a dedicated region of the volatile memory 210. The buffer 800 may be sized to store current, final and next display state values for the first quantity of pixel locations in the display 204. In one embodiment, the buffer 800 may be a FIFO.

In operation, the buffer 800 may be used in a pixel synthesis operation. In a single waveform update, for each pixel in the region to be updated, the next display state value is copied from the next state buffer 310 into both the current state buffer 306 and into the buffer 800. In addition, the desired new display state is copied from the image buffer 302 into both the next state buffer 310 and into the buffer 800. In linked waveforms update mode, the next display state value is copied from the next state buffer 310 into both the current state buffer 306 and into the buffer 800. In addition, the desired new display state is copied from the image buffer 302 into both the final state buffer 308 and into the buffer 800. Further, a valid display state (either a mapped or desired display state as described above) is copied into both the next state buffer 310 and the buffer 800. In the first frame of the waveform, the update pipe sequencer 223 may obtain the current and next state values from the buffer 800. In the second and subsequent frames, the update pipe sequencer 223 may obtain the current and next state values from the update buffer 304.

The use of the buffer 800 may advantageously save memory bandwidth because data in the first frame is read from the buffer instead of the memory 210. The update buffer 800 may used with either the single or linked waveforms modes.

Figure 9:
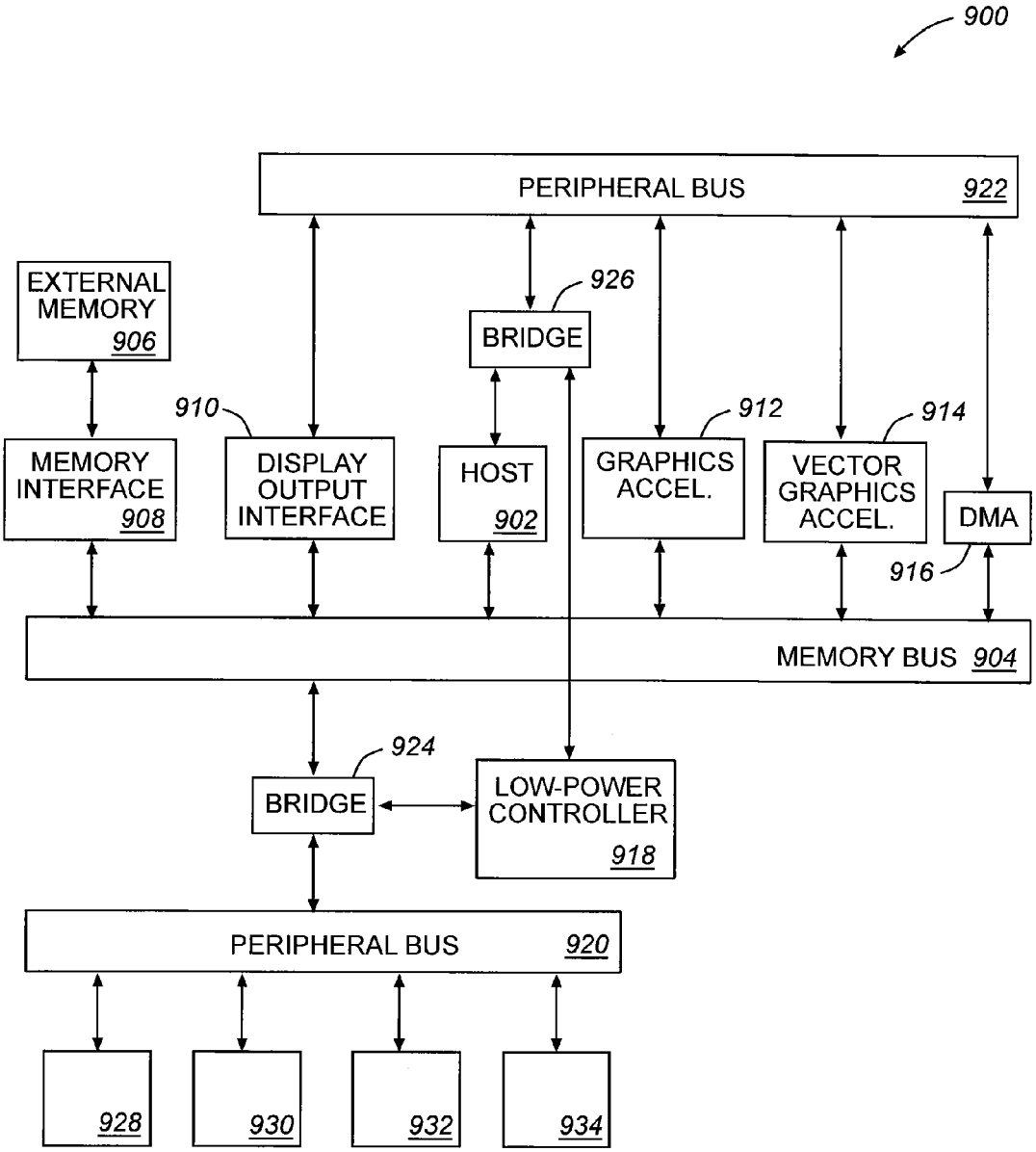
FIG. 9 illustrates an exemplary display system according to a first alternative embodiment.

FIG. 9 illustrates an exemplary display system according to a first alternative embodiment. The system 900 includes a host 902 and a memory bus 904. The host 902 may be a relatively high-performance CPU, such as the 64-bit ARM Cortex-A9 processor. The memory bus 904 may be a relatively high-performance bus. The system 900 includes an external memory 906 that may be coupled to the bus 904 via a memory interface 908. In addition, a display output interface 910, a graphics accelerator 912, a vector graphics accelerator 914, and a DMA engine 916 may be coupled to the bus 904. The system 900 may also include an impulse-driven, electrophoretic display (not shown).

According to one embodiment, the system 900 includes a low-power micro-controller 918, peripheral bus 920, and a peripheral bus 922. The low-power micro-controller 918 may be, for example, a 16-bit processor. The low-power micro-controller 918 may be coupled to the bus 904 and the bus 920 via a bridge 924. In addition, the low-power micro-controller 918 may be coupled to the bus 926 via a bridge 926. The host 902 and micro-controller 918 may access peripherals 928, 930, 932, and 934 via the bridge 924. Similarly, the host 902 and micro-controller 918 may access peripherals coupled with the bus 922 via the bridge 926.

The system 900 may be advantageously employed to save power. For example, host 902 might be in a "wait-for-interrupt" ("WFI/WFE") mode during a display update of an impulse-driven, electrophoretic display. As mentioned, depending on the drive scheme and display type, a display update may take on the order of 120 to 4,000 ms. With the micro-controller 918, the host 902 may be shut down or placed in dormant mode during a display update. During the display update, the micro-controller 918 takes over the WFI/WFE task in addition to performing display update tasks.

Figure 10:
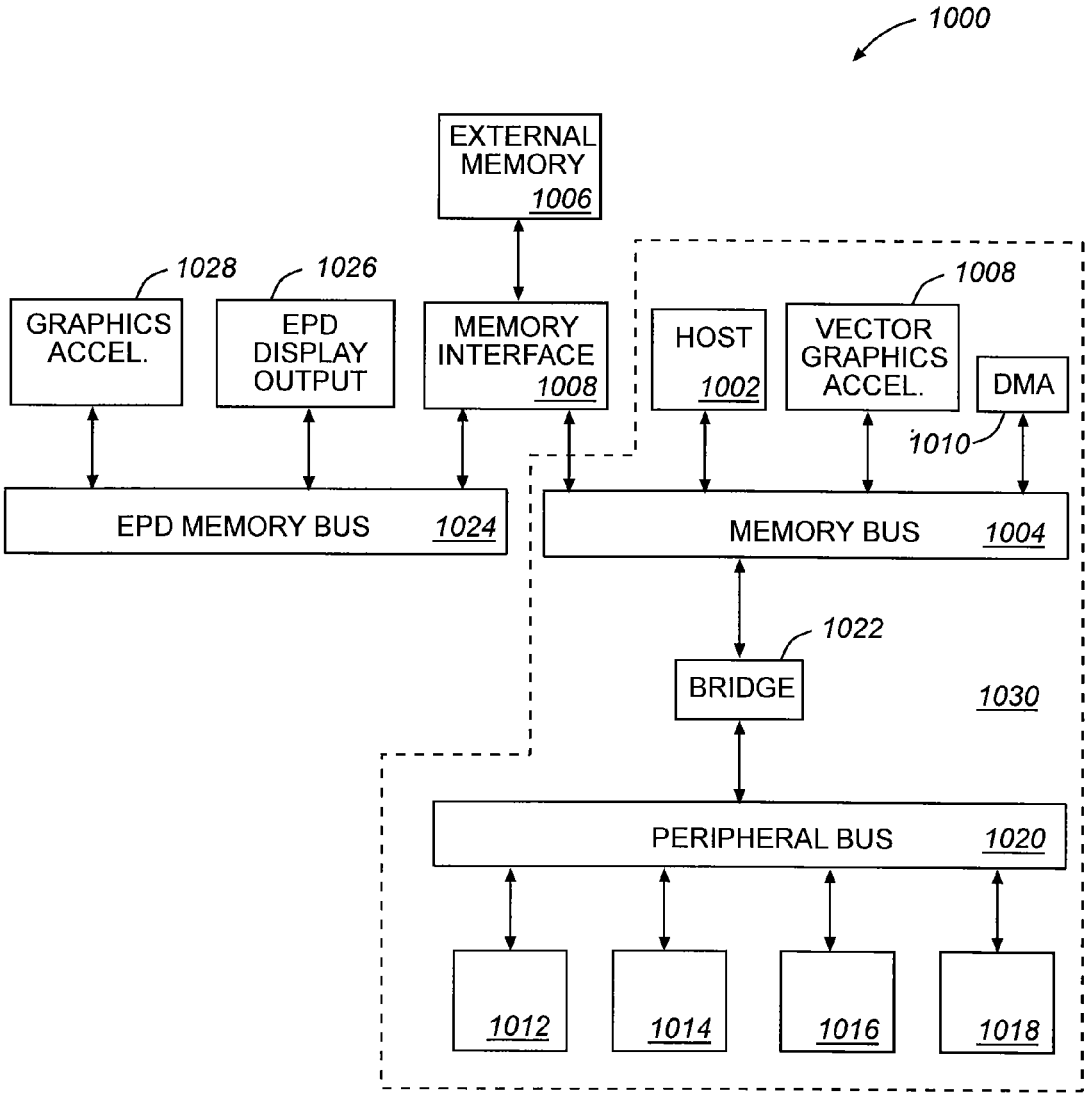
FIG. 10 illustrates an exemplary display system according to a second alternative embodiment.

FIG. 10 illustrates an exemplary display system according to a second alternative embodiment. The system 1000 includes a host 1002 and a memory bus 1004. The host 1002 may be a relatively high-performance CPU, such as an ARM Cortex-A9 processor. The memory bus 1004 may be a relatively high-performance bus. The system 1000 includes an external memory 1006 that may be coupled to the bus 1004 via a memory interface 1008. In addition, a vector graphics accelerator 1008 and a DMA engine 1010 may be coupled to the bus 1004. Peripheral devices 1012, 1014, 1016, and 1018 may be coupled to a peripheral bus 1020. The Host 1002 and other devices coupled with the memory bus 1004 may access devices coupled with the peripheral bus 1020 via a bridge 1022.

According to one embodiment, the system 1000 also includes a display output interface 910 and a graphics accelerator 912 coupled to an electrophoretic display memory bus 1024. The memory interface 1008 is coupled with the display memory bus 1024, permitting the display output interface 910 and graphics accelerator 912 to access the external memory 1006. The system 1000 may also include an impulse-driven, electrophoretic display (not shown).

The system 1000 may be advantageously employed to save power. For example, the devices included within the dashed line in FIG. 10 may be considered a first power domain 1030. During a display update of an impulse-driven, electrophoretic display, the host 1002, bus 1004, and all other devices in the first power domain 1030 may be shut down or put into sleep mode.

One problem with eBook readers is that the decoding of portable document format or PDF files is slow. According to a third alternative embodiment, hardware modules for accelerating the decoding of PDF files are provided. In addition, hardware acceleration modules may be provided to accelerate the decoding of file in other document formats, such as the ePub format. Hardware acceleration modules may be provided for parsing and layout. In addition, the hardware acceleration modules may be provided along with an Open Vector Graphics (OVG) core, which may be used for rendering.

In an exemplary eBook reader system, the hardware acceleration modules may be provided in an IC, such as a display controller, one or more dedicated ICs, or in a SOC IC. The hardware acceleration modules may be controlled by a set of software function calls from one or more processor cores. One advantage of providing separate hardware acceleration modules is that each module functions independently of the others. This permits a user to choose a variety of levels of acceleration based on a selected acceleration method or a particular type of document. Some or all aspects of document decoding may be accelerated in hardware.

PDF decoding may be divided into three layers: (a) read and parse; (b) layout; and (c) rendering. Hardware acceleration modules may be provided for read and parse, and layout layers. Rendering may be accomplished by several methods, such as bitmap rendering and vector graphics rendering. Rendering using a vector graphics rendering method may be performed using the OVG core. In addition to the advantage of reducing the time required to decode files in PDF and other similar document formats, another advantage is a reduction in the power used by one or more processor cores performing decoding in software.

Various embodiments may be implemented using hardware elements, software elements, or a combination of hardware and software elements. Examples of hardware elements may include processors, microprocessors, circuits, circuit elements, integrated circuits, application specific integrated circuits (ASIC), programmable logic devices (PLD), digital signal processors (DSP), field programmable gate array (FPGA), logic gates, registers, semiconductor devices, chips, microchips, chip sets, and so forth.

Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, hardware description code, code segments, computer code segments, words, values, symbols, or any combination thereof Some embodiments may be implemented, for example, using a tangible machine-readable medium (storage medium) or article which may store an instruction or a set of instructions that, if executed by a machine, may cause the machine to perform a method or operations in accordance with the embodiments, or may cause the machine to program a PLD, FPGA, or similar device. Such a machine may include, for example, any suitable processing platform, computing platform, computing device, processing device, computing system, processing system, computer, processor, PLD or FPGA programmer, or the like, and may be implemented using any suitable combination of hardware and software.

The machine-readable medium (storage medium) or article may include, for example, any suitable type of memory unit, memory device, memory article, memory medium, storage device, storage article, storage medium or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled, or interpreted programming language. Examples of code include, but are not limited to C, C++, Verilog, and VHDL.

The invention claimed is:

1. A method for changing the display states of one or more of the pixels of an impulse-driven, particle-based electrophoretic display device, comprising:

receiving a first display update command, the first display update command specifying desired display states for each of the pixels, and specifying at least first and second different drive schemes;

initiating execution of the first display update command including updating the pixels using the first drive scheme;

prior to completing the execution of the first display update command, determining whether the desired display states of the pixels remained static during the updating of the pixels using the first drive scheme; and continuing execution of the first display update command including updating the pixels using the second drive scheme in response to the desired display states of the pixels remaining static during the updating of the pixels using the first drive scheme;

wherein the updating of the pixels using the first drive scheme further comprises:

selecting waveforms for use in updating each of the pixels using the first drive scheme each waveform being selected using:

the desired display state of the pixel if the desired display state is a valid display state for the first drive scheme, or a mapped display state of the pixel if the desired display state is an invalid display state for the first drive scheme.

2. The method of claim 1, further comprising terminating execution of the first update command without updating the pixels using the second drive scheme in response to the desired display states of the pixels changing during the updating of the pixels using the first drive scheme.

3. The method of claim 1, wherein the second drive scheme has a different duration than the first drive scheme.

4. The method of claim 1, wherein the second drive scheme has more gray levels than the first drive scheme.

5. The method of claim 1, wherein the method is implemented in hardware.

6. A display controller for changing the display states of one or more pixels of an impulse-driven, particle-based electrophoretic display device, comprising:

a first unit to select waveforms from a first drive scheme in response to a display update command that specifies a desired logic display state from among a predefined number of selectable display state options, said first drive schemes having a first number of available logic display states, said first number being different than said predefined number, the waveforms being selected for use in a first display update operation as part of the execution of said display update command, wherein the first unit selects waveforms using:

the desired logic display state specified in the display update command if the desired logic display state is included in the first number of logic display states of the first drive scheme, or a specific one of the first number of available logic display states of the first drive scheme that is pre-mapped to the specified desired logic display state if the specified desired display state is not included in the first number of logic display states of the first drive scheme;

wherein the first unit selects waveforms from a second drive scheme for use in a second display update operation as part of the execution of said display update command in response to the desired display states of the pixels having remained static during the first display update and the desired logic display state not being included in the first number of logic display states of the first drive scheme.

7. The display controller of claim 6, wherein the first unit selects waveforms from a third drive scheme for use in a third display update operation as part of the execution of said display update command in response to the desired display states of the pixels having remained static during the second display update and the desired logic display state not being included in a second number of logic display states of the second drive scheme.

8. The display controller of claim 6, wherein the second drive scheme includes more logic display states than the first drive scheme.

9. The display controller of claim 6, further comprising a second unit to provide the waveforms selected from the first drive scheme to a display power supply during the first display update, wherein the display power supply provides impulses to the display device.

10. An article comprising a machine-readable medium having stored thereon instructions that, when executed by a machine, cause the machine to execute the following steps:

(a) update the display states of one or more of the pixels of an impulse-driven, particle-based electrophoretic display device using a first drive scheme;

(b) determine whether the desired display states of the pixels remained static during the updating of the pixels using the first drive scheme; and (c) upon completion of the updating of the pixels using he first drive scheme, update the pixels using a second drive scheme in response to the desired display states of the pixels remaining static during the updating of the pixels using the first drive scheme;

wherein step (a), step (b) and step (c) are executed in response to a single display update command that specifies the desired display states of the pixels; and wherein step (a) further comprises:

selecting waveforms from the first drive scheme for use in the updating of the display states of each of the pixels using the first drive scheme, each waveform being selected using:

the desired display state of the pixel if the desired display state is a valid display state for the first drive scheme, or a mapped display state of the pixel if the desired display state is an invalid display state for the first drive scheme.

11. The article of claim 10, wherein the second drive scheme has more gray levels than the first drive scheme.

12. The method of claim 1, wherein the at least first and second different drive schemes specified in first display update command are selected from among a plurality of drive schemes.

13. The method of claim 1, wherein said display update command is not a scroll display command.

* * * * *